US012686898B2

(12) United States Patent
Kim

(10) Patent No.: US 12,686,898 B2
(45) Date of Patent: Jul. 21, 2026

(54) HIGH STRENGTH THIN STEEL MATERIAL FOR API HAVING EXCELLENT RESISTANCE TO DEFORMATION AND METHOD OF MANUFACTURING SAME

(71) Applicant: POSCO CO., LTD, Pohang-si (KR)

(72) Inventor: Jin-You Kim, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 531 days.

(21) Appl. No.: 18/265,362

(22) PCT Filed: Nov. 22, 2021

(86) PCT No.: PCT/KR2021/017158

§ 371 (c)(1),
(2) Date: Jun. 5, 2023

(87) PCT Pub. No.: WO2022/131597

PCT Pub. Date: Jun. 23, 2022

(65) Prior Publication Data

US 2024/0035106 A1 Feb. 1, 2024

(30) Foreign Application Priority Data

Dec. 17, 2020 (KR) ..... 10-2020-0177707

(51) Int. Cl.

| | |
|---|---|
| ***C21D 9/00*** | (2006.01) |
| ***C21D 1/18*** | (2006.01) |
| ***C21D 1/84*** | (2006.01) |
| ***C21D 6/00*** | (2006.01) |
| ***C21D 8/02*** | (2006.01) |
| ***C21D 8/0221*** | (2026.01) |
| ***C21D 8/0247*** | (2026.01) |
| ***C22C 38/00*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/58*** | (2006.01) |

(52) U.S. Cl.

CPC ..... *C21D 9/0081* (2013.01); *C21D 1/18* (2013.01); *C21D 1/84* (2013.01); *C21D 6/004* (2013.01); *C21D 6/005* (2013.01); *C21D 6/008* (2013.01); *C21D 8/02* (2013.01); *C21D 8/0226* (2013.01); *C21D 8/0263* (2013.01); *C22C 38/001* (2013.01); *C22C 38/002* (2013.01); *C22C 38/02* (2013.01); *C22C 38/06* (2013.01); *C22C 38/42* (2013.01); *C22C 38/44* (2013.01); *C22C 38/46* (2013.01); *C22C 38/48* (2013.01); *C22C 38/58* (2013.01); *C21D 2211/002* (2013.01); *C21D 2211/005* (2013.01); *C21D 2211/009* (2013.01)

(58) Field of Classification Search

CPC ..... C21D 9/0081

See application file for complete search history.

(56) References Cited

U.S. PATENT DOCUMENTS

| | | | | |
|---|---|---|---|---|
| 11,230,755 | B2 * | 1/2022 | Sano | C22C 38/001 |
| 11,396,689 | B2 * | 7/2022 | Bae | C22C 38/001 |
| 2003/0217795 | A1 * | 11/2003 | Asahi | C22C 38/12 148/521 |
| 2010/0119860 | A1 | 5/2010 | Hitoshi et al. | |
| 2012/0241057 | A1 | 9/2012 | Shimamura et al. | |
| 2014/0352852 | A1 | 12/2014 | Nakata et al. | |
| 2020/0347469 | A1 | 11/2020 | Jung | |
| 2024/0229200 | A1 | 7/2024 | Matsumoto et al. | |

FOREIGN PATENT DOCUMENTS

| | | | | |
|---|---|---|---|---|
| CN | 101857945 | A | 10/2010 | |
| CN | 102549186 | A | 7/2012 | |
| CN | 102549189 | A | 7/2012 | |
| CN | 103160756 | A | 6/2013 | |
| CN | 103725988 | A | 4/2014 | |
| CN | 111542636 | A | 8/2020 | |
| EP | 4206338 | A1 * | 7/2023 | C22C 38/02 |
| JP | 05-17820 | A | 1/1993 | |
| JP | 06-322479 | A | 11/1994 | |
| JP | 2003-268484 | A | 9/2003 | |
| JP | 2003-293089 | A | 10/2003 | |
| JP | 2006-299415 | A | 11/2006 | |
| JP | 2009-161824 | A | 7/2009 | |
| JP | 2009-228040 | A | 10/2009 | |
| JP | 2009-228099 | A | 10/2009 | |
| JP | 2011-74443 | A | 4/2011 | |
| JP | 2012-17522 | A | 1/2012 | |
| JP | 2013-23714 | A | 2/2013 | |
| JP | 2015-54983 | A | 3/2015 | |

(Continued)

OTHER PUBLICATIONS

Office Action issued Jul. 2, 2024 in Japanese Application No. 2023-532293.

(Continued)

*Primary Examiner* — Christopher S Kessler
(74) *Attorney, Agent, or Firm* — Sughrue Mion, PLLC

(57) ABSTRACT

An embodiment of the present invention provides a high strength thin steel material for API having excellent resistance to deformation and a method of manufacturing same, the steel material comprising, in weight %, C: 0.05-0.15%, Si: 0.5% or less (0% excluded), Mn: 0.5-2.5%, Nb: 0.05% or less (0% excluded), V: 0.004% or less (0% excluded), Mo: 0.03-0.2%, Cr: 0.1-0.3%, P: 0.03% or less (0% excluded), S: 0.015% (0% excluded), Al: 0.05% or less (0% excluded), N: 0.01% or less (0% excluded), and the balance being Fe and other inevitable impurities, wherein the microstructure of the steel material comprises, in area %, ferrite: 10~30% and the balance being bainite, the ferrite having an average crystal grain size of 15-30 μm and including 3,000/$\mu m^2$ or less V-based precipitates.

13 Claims, No Drawings

(56) References Cited

FOREIGN PATENT DOCUMENTS

| | | | | |
|---|---|---|---|---|
| JP | 6256652 | B2 * | 1/2018 | ..... C21D 8/02 |
| KR | 10-2010-0033413 | A | 3/2010 | |
| KR | 10-2016-0025185 | A | 3/2016 | |
| KR | 10-2019-0076768 | A | 7/2019 | |
| WO | 2013/099192 | A1 | 7/2013 | |
| WO | 2021/200402 | A1 | 10/2021 | |

OTHER PUBLICATIONS

International Search Report for PCT/KR2021/017158 dated Mar. 21, 2022.
Communication issued Mar. 21, 2025 in Chinese Application No. 202180085003.8.

* cited by examiner

HIGH STRENGTH THIN STEEL MATERIAL FOR API HAVING EXCELLENT RESISTANCE TO DEFORMATION AND METHOD OF MANUFACTURING SAME

This Application is a National Stage of International Application No. PCT/KR2021/017158 filed Nov. 22, 2021, claiming priority based on Korean Patent Application No. 10-2020-0177707 filed Dec. 17, 2020, the entire disclosures of which are incorporated herein by reference.

TECHNICAL FIELD

The present disclosure relates to a high strength thin steel material for API having excellent resistance against deformation and a method of manufacturing the same, and more particularly, a high strength thin steel material for API having excellent resistance against deformation which may be used for transporting crude oil and a method of manufacturing the same.

BACKGROUND ART

In the case of API steel material for pipeline used when transporting crude oil to the place of use after mining, to safely protect the structure against external impacts and deformation caused by external factors or earthquakes, high strength and deformation stability of a steel material may be necessary. Therefore, in the prior art, as an API material for transporting crude oil, a large amount of solid-solution hardening elements such as C, Si, Mn, and Cr may be added to high-purity steel in which impurities in steel are reduced, or a hot-rolled steel material of which strength is enhanced by adding a large amount of precipitation-strengthening elements such as Ti, Nb, and V has been mainly used.

However, as earthquake-resistant design has recently been strengthened, a low-yield ratio characteristic is required as an item for assessing deformation stability against earthquakes, and a hot-rolled steel material in which a large amount of precipitation strengthening elements such as Ti, Nb, and V are added may have high yield strength due to the effect of excessive precipitates, and accordingly, it may be difficult to implement a low-yield ratio characteristic while maintaining high strength.

SUMMARY OF INVENTION

Technical Problem

An aspect of the present disclosure is to provide a high strength thin steel material for API having a low-yield ratio and excellent resistance against deformation and a method of manufacturing the same.

Solution to Problem

As an aspect of the present disclosure, the present disclosure provides a high strength thin steel material for API having excellent resistance against deformation, the steel material including, by weight %, C: 0.05-0.15%, Si: 0.5% or less (excluding 0%), Mn: 0.5-2.5%, Nb: 0.05% or less (excluding 0%), V: 0.004% or less (excluding 0%), Mo: 0.03-0.2%, Cr: 0.1-0.3%, P: 0.03% or less (excluding 0%), S: 0.015% (excluding 0%), Al: 0.05% or less (excluding 0%), N: 0.01% or less (excluding 0%), and a balance of Fe and other inevitable impurities, wherein a microstructure of the steel material includes, by area %, ferrite: 10-30% and a balance of bainite, wherein ferrite has an average grain size of 15-30 μm, and wherein 3,000/μm$^2$ or less of V-based precipitates are included.

As another aspect of the present disclosure, the present disclosure provides a method of manufacturing a high strength thin steel material for API having excellent resistance against deformation, the method including reheating a slab including, by weight %, C: 0.05-0.15%, Si: 0.5% or less (excluding 0%), Mn: 0.5-2.5%, Nb: 0.05% or less (excluding 0%), V: 0.004% or less (excluding 0%), Mo: 0.03-0.2%, Cr: 0.1-0.3%, P: 0.03% or less (excluding 0%), S: 0.015% (excluding 0%), Al: 0.05% or less (excluding 0%), N: 0.01% or less (excluding 0%), and a balance of Fe and other inevitable impurities at 1200-1400° C., obtaining a hot-rolled steel material by rough-rolling the reheated slab and finishing-rolling the slab at an austenite single-phase temperature; water-cooling the hot-rolled steel material to a temperature of 650-750° C. at a rate of 40-60° C./sec and air-cooling the steel material for 3-7 seconds; and water-cooling the air-cooled hot-rolled steel material to a temperature of 450-600° C. at a rate of 30-50° C./sec and winding the steel material.

Advantageous Effects of Invention

According to an aspect of the present disclosure, a high strength thin steel material for API having a low-yield ratio and excellent resistance against deformation and a method of manufacturing the same may be provided.

Various and beneficial advantages and effects of the present disclosure are not limited to the above-described examples, and may be more easily understood in the process of describing specific embodiments of present disclosure.

BEST MODE FOR INVENTION

Hereinafter, a high strength thin steel material for API having excellent resistance against deformation according to an embodiment of the present disclosure will be described.

First, an alloy composition of the present disclosure will be described. The content of the alloy composition described below may be weight % unless otherwise indicated.

C: 0.05-0.15%

C may be the most economical and effective element for securing strength. When the C content is less than 0.05%, it may be difficult to secure target strength even when a precipitation enhancing element such as Nb is added. When the C content exceeds 0.15%, ductility may deteriorate due to excessive strength increase. Therefore, the content of C may be preferably in the range of 0.05-0.15%. A lower limit of the C content may be more preferably 0.06%, and even more preferably 0.07%. An upper limit of the C content may be more preferably 0.14%, more preferably 0.12%, and most preferably 0.10%.

Si: 0.5% or Less (Excluding 0%)

Si may contribute to the increase in strength by deoxidation and solid solution strengthening of molten steel, but may not be intentionally added in the present disclosure, and even when Si is not intentionally added, there is no difficulty in terms of securing physical properties. However, when the Si content exceeds 0.5%, red scale due to Si may be formed on the surface of the hot-rolled steel material, and surface quality and weldability may be deteriorated. Therefore, the Si content may be preferably 0.5% or less. The Si content may be more preferably 0.45% or less, more preferably 0.4% or less, and most preferably 0.35% or less.

Mn: 0.5-2.5%

Mn may be an element effective in solid solution strengthening of steel, and may be preferably added in an amount of 0.5% or more to ensure proper strength. However, when the Mn content exceeds 2.5%, there may be a risk of central segregation in the continuous casting process. Therefore, the Mn content may be preferably 0.5-2.5%. A lower limit of the Mn content may be more preferably 0.8%, more preferably 1.0%, and most preferably 1.2%. An upper limit of the Mn content may be more preferably 2.3%, more preferably 2.0%, and most preferably 1.8%.

Nb: 0.05% or Less (Excluding 0%)

Nb may be a precipitation strengthening element, and may be effective in securing strength by refining grains by generating NbC-based precipitates. However, when the Nb content exceeds 0.05%, the effect of grain refinement may be excessive which may increase yield strength to tensile strength such that it may be difficult to implement a low yield ratio. Therefore, in the present disclosure, the content of Nb may be managed to be 0.05% or less. An upper limit of the Nb content may be more preferably 0.045%, more preferably 0.04%, and most preferably 0.035%. A lower limit of the Nb content may be more preferably 0.1% more preferably 0.015%, and most preferably 0.02%.

V: 0.004% or Less (Excluding 0%)

V may also be a precipitation strengthening element, and may be effective in securing strength of steel. In particular, V-based precipitates may be precipitated at a lower temperature than Nb-based precipitates, such that there may be an effect of forming fine precipitates during winding. However, since the fine precipitates formed as above may be relatively small in size and may be evenly dispersed, the precipitates may cause a yield point phenomenon and may increase the yield ratio of the steel material, which may be disadvantageous. Therefore, in the present disclosure, the content of V may be reduced, and accordingly, the content of V may be managed to be 0.004% or less. The V content may be more preferably 0.003% or less, and even more preferably 0.0025% or less.

Mo: 0.03-0.2%

Mo may be a representative element improving hardenability of steel and may greatly improve the ability to generate a low-temperature transformation structure even at a low cooling rate. Accordingly, it may be an effective element for securing strength of steel by forming a low-temperature transformation structure such as bainite. In the present disclosure, the content of Mo may be 0.03% or more preferably to obtain the above effect. However, since Mo may be a relatively expensive element as compared to other alloy elements, and when the content thereof is excessively high, toughness may be deteriorated, and thus, the Mo content may be preferably 0.2% or less. Therefore, the Mo content may be preferably in the range of 0.03-0.2%. A lower limit of the Mo content may be more preferably 0.035%, more preferably 0.04%, and most preferably 0.045%. An upper limit of the Mo content may be more preferably 0.18%, more preferably 0.15%, and most preferably 0.13%.

Cr: 0.1-0.3%

Cr may strengthen steel by solid solution and may delay bainite phase transformation during cooling such that Cr may contribute to forming equiaxed ferrite, and may particularly increase hardenability more effectively when added together with Mo. In the present disclosure, the content of Cr may be 0.1% or more preferably to obtain the above effect. However, when the Cr content exceeds 0.3%, weldability and brittleness may deteriorate. Therefore, the Cr content may be preferably in the range of 0.1-0.3%. An upper limit of the Cr content may be more preferably 0.27%, more preferably 0.25%, and most preferably 0.23%. A lower limit of the Cr content may be more preferably 0.11%, more preferably 0.12%, and most preferably 0.13%.

P: 0.03% or Less (Excluding 0%)

P may be one of impurities inevitably included in steel, and it may be preferable to manage the content thereof as low as possible. In particular, when the content of P is excessive, the risk of weldability deterioration and brittleness of steel may increase, and thus, in the present disclosure, the content of P may be managed to be 0.03% or less. The P content may be more preferably 0.025% or less, more preferably 0.023% or less, and most preferably 0.02% or less.

S: 0.015% (Excluding 0%)

S may be one of impurities inevitably included in steel, and it may be preferable to manage the content thereof as low as possible. In particular, when the content of S is excessive, non-metallic inclusions may be formed by combining with Mn, and a risk of brittleness of steel may increase. Thus, in the present disclosure, the content of S may be managed to 0.015% or less. The S content may be more preferably 0.013% or less, more preferably 0.012% or less, and most preferably 0.011% or less.

Al: 0.05% or Less (Excluding 0%)

Al may contribute to deoxidation of molten steel, but Al may not be intentionally added in the present disclosure, and even when Al is not added, there is no difficulty in terms of securing physical properties. However, when the Al content exceeds 0.05%, nozzle clogging may occur during continuous casting. Therefore, the Al content may be preferably 0.05% or less, more preferably 0.047% or less, even more preferably 0.045% or less, and most preferably 0.04% or less.

N: 0.01% or Less (Excluding 0%)

N may contribute to improving strength of steel, but N may not be intentionally added in the present disclosure, and even when N is not added, there may be no difficulty in terms of securing physical properties. However, when the N content exceeds 0.01%, a risk of brittleness of the steel may increase. Therefore, the content of N may be preferably 0.01% or less. The N content may be more preferably 0.009% or less, even more preferably 0.007% or less, and most preferably 0.005% or less.

A remainder of the composition described above may be iron (Fe). However, in a general manufacturing process, inevitable impurities may be inevitably added from raw materials or an ambient environment, and thus, impurities may not be excluded. A person skilled in the art of a general manufacturing process may be aware of the impurities, and thus, the descriptions of the impurities may not be provided in the present disclosure.

Ni: Less than 0.05% (Excluding 0%)

Ni may improve both strength and toughness of steel, but in the present disclosure, even when Ni is not intentionally added, there may be no difficulty in terms of securing physical properties. However, since Ni is a relatively expensive element as compared to other alloy elements, when the content thereof exceeds 0.05%, economic feasibility may deteriorate. Therefore, the Ni content may be preferably 0.05% or less. The Ni content may be more preferably 0.04% or less, even more preferably 0.035% or less, and most preferably 0.03% or less.

Cu: 0.05% or Less (Excluding 0%)

Cu serves to increase the strength by forming fine precipitates, but in the present disclosure, even when Cu is not intentionally added, there is no difficulty in terms of securing physical properties. However, when the Cu content exceeds 0.01%, hot structural stability and room temperature workability may be deteriorated. Therefore, the Cu content may be preferably 0.01% or less. The Cu content may be more preferably 0.04% or less, even more preferably 0.035% or less, and most preferably 0.03% or less.

Meanwhile, the steel material in the present disclosure preferably may have a carbon equivalent (Ceq) of 0.4 or less, which is defined by [Equation 1] below. When the carbon equivalent exceeds 0.4, it may be difficult to secure weldability.

$$Ceq=[C]+[Mn]/6+([Cu]+[Ni])/15+([Cr]+[Mo]+[V])/5 \quad (1)$$

(Here, [C], [Mn], [Cu], [Ni], [Cr], [Mo], and [V] may refer to the contents (% by weight) of the corresponding elements, respectively)

Hereinafter, the microstructure of present disclosure will be described.

The microstructure of the steel material preferably may include ferrite: 10-30%, the balance of bainite. The low-yield ratio characteristic in present disclosure steel material may be characterized by being implemented from exhibiting continuous yielding behavior by sufficient movable potential generated due to volume change of a high fraction of bainite. Therefore, in the present disclosure, the above effect may be obtained by including bainite as a main structure. Ferrite may be a soft phase and may implement the effect of improving toughness and securing elongation. When the fraction of the ferrite is less than 10%, there may be a disadvantage in that strength may be excessively increased and toughness may be low, and when the fraction exceeds 30%, there may be a disadvantage in that it may be difficult to secure strength. An upper limit of the ferrite fraction may be more preferably 27%, and even more preferably 25%. A lower limit of the ferrite fraction may be more preferably 13%, and more preferably 15%. In the present disclosure, a pearlite structure may not be intentionally created, but may be formed inevitably in the manufacturing process. When pearlite is included in a small amount, pearlite may have an effect of contributing to generation of movable potential. However, when the fraction is excessively high, toughness may be deteriorated, and thus, the fraction of pearlite may be preferably 10% or less. The fraction of pearlite may be more preferably 7% or less, even more preferably 5% or less, and most preferably 3% or less.

The ferrite preferably may have an average grain size of 15-30 μm. The relationship between an average grain size and yield strength of ferrite may be represented by the Hall-Petch equation, and when an average grain size of ferrite is managed to be the above-described level, desired yield strength may be secured. When a ferrite average grain size is less than 15 μm, yield strength may be excessively high, and when the ferrite average grain size exceeds 30 μm, yield strength may be deteriorated, such that it may be difficult to obtain desired strength. An upper limit of the ferrite average grain size may be more preferably 27 μm, and even more preferably 25 μm. A lower limit of the ferrite average grain size may be more preferably 17 μm, and even more preferably 20 μm.

Meanwhile, according to one example, bainite may have an average packet size of 5-20 μm. The average bainite packet size may be a factor affecting toughness, and when the average bainite packet size exceeds 20 μm, toughness may be deteriorated. When the bainite average packet size is less than 5 μm, yield strength may excessively increase. An upper limit of the bainite average packet size may be more preferably 17 μm, and even more preferably 15 μm. A lower limit of the bainite average packet size may be more preferably 8 μm, and even more preferably 10 μm.

In the present disclosure, the steel material may include 3,000/μm$^2$ or less of V-based precipitates. That is, it may be intended to suppress the formation of a large amount of the V-based precipitate as much as possible. When the number of V-based precipitates per unit area exceeds 3,000/μm$^2$, a large amount of finely formed V-based precipitates may hinder the movement of dispositions, dispositions may be piled up, thereby increasing a yield point phenomenon. When the yield point phenomenon increases, yield strength as compared to tensile strength may increase, such that it may be difficult to secure the desired low-yield ratio. The number per unit area of the V-based precipitates may be more preferably 2,700/μm$^2$ or less, and even more preferably 2,500/μm$^2$ or less. Meanwhile, in the present disclosure, the specific type of the V-based precipitate is not particularly limited, but may be, for example, VC, VN, or V (C,N).

According to one example, the V-based precipitates may have an average diameter of 5-10 nm and a maximum diameter of nm or less. When the average diameter of the V-based precipitates is less than 5 nm, since the V-based precipitates are formed at a relatively low temperature, it may be difficult to sufficiently secure the number per unit area and a yield point rise may not be large. When the average diameter of the V-based precipitates exceeds 10 nm or the maximum diameter exceeds 20 nm, the yield point rise may not be large due to the coarse precipitates. The maximum diameter of the V-based precipitate may be more preferably 17 nm or less, and even more preferably 15 nm or less. The average diameter may refer to an average equivalent circular diameter of V-based precipitates detected by observing a cross-section in the thickness direction of the steel material, and the maximum diameter may refer to the maximum equivalent circular diameter of the V-based precipitates detected by observing a cross-section in the thickness direction of the steel material.

The steel material according to an embodiment of the present disclosure provided as described above may have a low yield ratio and may have high strength and excellent deformation stability. For example, the steel material may have yield strength: 500-700 MPa, tensile strength: 600-800 MPa, yield ratio: 80-85%, elongation: 20-30%, impact toughness at −30° C.: 80 J or more.

The steel material in the present disclosure described above may be manufactured by various methods, and the method of manufacturing the same may not be particularly limited. However, as a preferable example, the steel material may be prepared by the method as below.

Hereinafter, the method for manufacturing a high strength thin steel material for API having excellent resistance against deformation according to an embodiment of the present disclosure will be described.

First, a slab having the above-described alloy composition may be reheated at 1200-1400° C. When the reheating temperature is less than 1200° C., rolling load may be excessively increased in the hot-rolling process, which is a subsequent process, and a grain size of bainite and ferrite in the subsequent process may also be refined due to the refinement of the initial austenite size, such that yield strength may increase. When the reheating temperature exceeds 1400° C., a grain size of a final microstructure may not be homogeneous due to partial coarsening by abnormal growth of a portion of austenite grains. A lower limit of the reheating temperature may be more preferably 1220° C., and even more preferably 1250° C. An upper limit of the reheating temperature may be more preferably 1350° C., even more preferably 1320° C., and most preferably 1300° C. In the present disclosure, the slab reheating time may not be particularly limited, and may be a general condition. As an example, although not limited thereto, the slab reheating time may be 100-400 minutes. When the slab reheating time is less than 100 minutes, alloying elements such as Mo may not be sufficiently dissolved, such that the contribution of hardenability during cooling may be low, and the size of the grain may not be sufficiently secured, such that yield strength may be increase. When the slab reheating time exceeds 400 minutes, the size of the initial austenite may be too coarse, such that it may be difficult to secure sufficient strength, which may be disadvantageous. A lower limit of the reheating time may be more preferably 120 minutes, even more preferably 150 minutes, and most preferably 180 minutes. An upper limit of the reheating time may be more preferably 350 minutes, even more preferably 320 minutes, and most preferably 300 minutes.

Thereafter, the reheated slab may be rough-rolled, and finishing-rolling may be performed at an austenite single phase temperature, thereby obtaining a hot-rolled steel material. Here, the rough-rolling may refer to a series of intermediate rolling processes performed before finishing-rolling, and in the present disclosure, specific conditions for rough-rolling are not particularly limited, and general conditions may be used. As an example, although not limited thereto, a thickness of the rough-rolled slab relative to the thickness of the reheated slab may be 10-25%, and the rough-rolling temperature may be determined to be a sufficiently high temperature at which the finish-rolling temperature may be secured. The finishing-rolling may be performed at an austenite single-phase temperature, which is to increase uniformity of the structure. According to an example, the temperature during the finishing-rolling may be 800-1000° C. During finishing-hot-rolling in the above temperature range, the austenite structure of the finishing-rolled hot-rolled steel material may have an average grain size of 10-40 μm. When the finishing-rolling temperature is less than 800° C., hot-rolling load may increase and productivity may decrease, and the grain may be excessively refined. When the temperature exceeds 1000° C., austenite grains of the slab may become excessively coarse, such that it may be difficult to secure target strength. A lower limit of the finishing-rolling temperature may be more preferably 830° C., and more preferably 850° C. An upper limit of the finishing-rolling temperature may be more preferably 970° C., even more preferably 950° C., and most preferably 930° C.

Thereafter, the hot-rolled steel material may be cooled. In this case, when cooling the hot-rolled steel material through general continuous cooling, it may be difficult to secure grains and packets in a desired size such that a yield ratio may be deteriorated. Therefore, in the present disclosure, the hot-rolled steel material may be cooled with water at a rate of 40-60° C./sec to a temperature of 650-750° C. and may be cooled in air for 3-7 seconds by two-stage cooling. Here, the temperature of 650-750° C. may be the temperature at which austenite may transform into ferrite the fastest, indicating that ferrite may be grown most efficiently at the temperature, and in the present disclosure, the above temperature range may be referred to as an intermediate temperature. When the intermediate temperature exceeds 750° C. or the air cooling time exceeds 7 seconds, ferrite may grow excessively and yield strength may deteriorate. When the intermediate temperature is less than 650° C. or the air cooling time is less than 3 seconds, a ferrite size may be excessively refined, such that it may be difficult to secure the yield ratio. A lower limit of the intermediate temperature may be more preferably 660° C., even more preferably 670° C., and most preferably 680° C. An upper limit of the intermediate temperature may be more preferably 740° C., even more preferably 730° C., and most preferably 720° C. A lower limit of the air cooling time may be more preferably 4 seconds. An upper limit of the air cooling time may be more preferably 6 seconds.

Thereafter, the air-cooled hot-rolled steel material may be cooled by water at a rate of 30-50° C./sec to a temperature of 450-600° C. and may be wound up. When strength is secured through Nb, V composite precipitates, which is a general method, it may be difficult to obtain sufficient bainite when cooling after an intermediate temperature due to insufficient hardenability. Accordingly, in the present disclosure, the above issues may be addressed through the appropriate addition of Mo. In the above winding temperature range, bainite may be most actively formed by Mo, and therefore, when winding is performed in the above temperature range, a bainite structure may be sufficiently formed, thereby securing desired strength. When the coiling temperature exceeds 600° C., the bainite structure may not be sufficiently secured such that it may be difficult to obtain desired strength. When the coiling temperature is less than 450° C., the shape of the plate may be degraded during cooling, and shape defects may occur during pipe-manufacturing. A lower limit of the winding temperature may be more preferably 470° C., and even more preferably 500° C. An upper limit of the coiling temperature may be more preferably 580° C., and even more preferably 550° C.

MODE FOR INVENTION

Hereinafter, present disclosure will be described in greater detail through examples. However, the description of the embodiments is only for exemplifying the implementation of the present disclosure, and the present disclosure is not limited to the description of the embodiments. This is because the scope of rights of present disclosure is determined by the matters described in the claims and the matters reasonably inferred therefrom.

Embodiment

A slab having an alloy composition as in Table 1 was reheated at 1280° C. for 250 minutes, and was rough-rolled, and a hot-rolled steel material was prepared under the conditions as in Table 2 below. In this case, a thickness of the crudely rolled slab relative to a thickness of the reheated slab was maintained to be constant at 20%. In comparative examples 2 and 4, cooling was continuously performed to the coiling temperature after finishing-rolling without cooling to an intermediate temperature and air cooling. The microstructure of the hot-rolled steel material prepared as described above was measured, the mechanical properties thereof were assessed, and the results thereof are listed in Table 4.

The microstructure was observed at 200× magnification using an optical microscope, and an area fraction of each phase was measured by applying the point count method based on the ASTM E 562 standard.

The average packet size of bainite and the average grain size of ferrite were measured using electron backscatter diffraction (EBSD). More specifically, EBSD was measured 10 times at random positions at 500× magnification, and as for the data obtained therethrough, an average value thereof was taken using the grain size program basically provided by TSL OIM Analysis 6.0 software.

The fraction and average diameter of the precipitates were measured by the carbon replication method through transmission electron microscopy (TEM).

As for mechanical properties, tensile samples were obtained in accordance with API standards in the width direction for each hot-rolled steel material, yield strength, tensile strength, and elongation were measured at room temperature (about 25° C.), and impact toughness was measured through a Charpy impact test at −30° C.

TABLE 1

| Steel type | Alloy composition (weight %) | | | | | | | | | | | | | |
|---|---|---|---|---|---|---|---|---|---|---|---|---|---|---|
| | C | Si | Mn | Nb | V | Mo | Cr | Ni | Cu | P | S | Al | N | Ceq |
| Invention steel 1 | 0.08 | 0.25 | 1.55 | 0.03 | 0.001 | 0.08 | 0.17 | 0.01 | 0.01 | 0.01 | 0.004 | 0.025 | 0.005 | 0.39 |
| Invention steel 2 | 0.085 | 0.25 | 1.5 | 0.03 | 0.001 | 0.075 | 0.17 | 0.01 | 0.01 | 0.01 | 0.004 | 0.025 | 0.005 | 0.39 |
| Comparative steel 1 | 0.04 | 0.25 | 1.5 | 0.05 | 0.05 | 0.1 | 0.17 | 0.01 | 0.01 | 0.01 | 0.004 | 0.025 | 0.005 | 0.36 |
| Comparative steel 2 | 0.07 | 0.25 | 1.5 | 0.05 | 0.05 | 0.01 | 0.17 | 0.01 | 0.01 | 0.01 | 0.004 | 0.025 | 0.005 | 0.37 |
| Comparative steel 3 | 0.16 | 0.25 | 1.3 | 0.03 | 0.001 | 0.01 | 0.17 | 0.01 | 0.01 | 0.01 | 0.004 | 0.025 | 0.005 | 0.41 |
| Comparative steel 4 | 0.07 | 0.25 | 1.5 | 0.05 | 0.015 | 0.01 | 0.17 | 0.01 | 0.01 | 0.01 | 0.004 | 0.025 | 0.005 | 0.36 |

TABLE 2

| Classification | Steel type | Finishing rolling temperature (° C.) | Water cooling rate (° C./s) | Intermediate temperature (° C.) | Air-cooling time (s) | Water cooling rate (° C./s) | Winding temperature ( ° C.) |
|---|---|---|---|---|---|---|---|
| Invention example 1 | Invention steel 1 | 890 | 50 | 700 | 5 | 50 | 540 |
| Comparative Example 1 | Invention steel 1 | 880 | 50 | 560 | 5 | 50 | 540 |
| Comparative Example 2 | Invention steel 1 | 890 | 50 | — | — | — | 540 |
| Invention example 2 | Invention steel 2 | 890 | 50 | 700 | 5 | 50 | 540 |
| Comparative Example 3 | Invention steel 2 | 880 | 50 | 560 | 5 | 50 | 540 |
| Comparative Example 4 | Invention steel 2 | 890 | 50 | — | — | — | 540 |
| Comparative Example 5 | Comparative steel 1 | 890 | 50 | 700 | 5 | 50 | 540 |
| Comparative Example 6 | Comparative steel 2 | 890 | 50 | 700 | 5 | 50 | 540 |
| Comparative Example 7 | Comparative steel 3 | 890 | 50 | 700 | 5 | 50 | 540 |
| Comparative Example 8 | Comparative steel 4 | 890 | 50 | 700 | 5 | 50 | 540 |

TABLE 3

| Classification | Bainite fraction (area %) | Bainite average packet size (μm) | Ferrite fraction (area %) | Ferrite Average grain size (μm) | Perlite fraction (area % ) | V-type precipitate fraction (pcs/μm$^2$) | V-type precipitates average diameter (nm) |
|---|---|---|---|---|---|---|---|
| Invention example 1 | 73 | 13 | 25 | 26 | 2 | 1,100 | 8 |
| Comparative Example 1 | 77 | 8 | 23 | 14 | 0 | 1,200 | 7 |
| Comparative Example 2 | 77 | 8 | 23 | 12 | 0 | 1,200 | 6 |
| Invention example 2 | 74 | 13 | 24 | 26 | 2 | 1,200 | 8 |

TABLE 3-continued

| Classification | Bainite fraction (area %) | Bainite average packet size (μm) | Ferrite fraction (area %) | Ferrite Average grain size (μm) | Perlite fraction (area % ) | V-type precipitate fraction (pcs/μm$^2$) | V-type precipitates average diameter (nm) |
|---|---|---|---|---|---|---|---|
| Comparative Example 3 | 77 | 8 | 22 | 13 | 1 | 1,200 | 7 |
| Comparative Example 4 | 78 | 8 | 22 | 12 | 0 | 1,300 | 6 |
| Comparative Example 5 | 3 | 11 | 95 | 12 | 2 | 14,000 | 5 |
| Comparative Example 6 | 33 | 9 | 65 | 10 | 2 | 15,000 | 4 |
| Comparative Example 7 | 93 | 10 | 4 | 10 | 3 | 1,300 | 5 |
| Comparative Example 8 | 32 | 9 | 67 | 10 | 1 | 5,000 | 4 |

TABLE 4

| Classification | Yield strength (MPa) | Tensile strength (MPa) | Elongation (%) | Yield ratio (%) | Impact toughness (J, @−30° C.) |
|---|---|---|---|---|---|
| Invention example 1 | 545 | 645 | 29 | 84 | 106 |
| Comparative Example 1 | 586 | 665 | 28 | 88 | 111 |
| Comparative Example 2 | 593 | 668 | 28 | 89 | 109 |
| Invention example 2 | 547 | 646 | 29 | 85 | 100 |
| Comparative Example 3 | 591 | 669 | 28 | 88 | 103 |
| Comparative Example 4 | 592 | 669 | 28 | 88 | 106 |
| Comparative Example 5 | 581 | 630 | 31 | 92 | 120 |
| Comparative Example 6 | 590 | 645 | 30 | 91 | 108 |
| Comparative Example 7 | 532 | 640 | 23 | 83 | 45 |
| Comparative Example 8 | 572 | 630 | 33 | 91 | 112 |

As indicated in tables 1 to 4, in inventive examples 1 and 2 satisfying the alloy composition and manufacturing conditions suggested by the present disclosure, the microstructure and precipitate desired by the present disclosure were obtained. Accordingly, yield strength: 500-700 MPa, tensile strength: 600-800 MPa, yield ratio: 80-85%, elongation: 20-30% were satisfied.

In comparative examples 1 to 4, which satisfied the alloy composition suggested by the present disclosure but did not satisfy the manufacturing conditions, the average grain size of ferrite to be obtained by the present disclosure was not obtained, such that the yield ratio was poor.

In comparative examples 5 to 8, which satisfied the manufacturing conditions suggested by the present disclosure but did not satisfy the alloy composition, the microstructure or precipitate conditions of the present disclosure was not obtained, such that the desired mechanical properties intended by the present disclosure was not secured.

The invention claimed is:

1. A steel material, the steel material comprising:

by weight %, C: 0.05-0.15%, Si: 0.5% or less (excluding 0%), Mn: 0.5-2.5%, Nb: 0.05% or less (excluding 0%), V: 0.004% or less (excluding 0%), Mo: 0.03-0.2%, Cr: 0.1-0.3%, P: 0.03% or less (excluding 0%), S: 0.015% (excluding 0%), Al: 0.05% or less (excluding 0%), N: 0.01% or less (excluding 0%), and a balance of Fe and other inevitable impurities, wherein a microstructure of the steel material includes, by area %, ferrite: 10-30% and a balance of bainite, wherein ferrite has an average grain size of 15-30 μm, and wherein 3,000/μm$^2$ or less of V-based precipitates are included.

2. The steel material of claim 1, wherein the other inevitable impurities include at least one of Ni and Cu, and a content thereof is suppressed to Ni: 0.05% or less (excluding 0%) and Cu: 0.05% or less (excluding 0%).

3. The steel material of claim 1, wherein a carbon equivalent (Ceq) of the steel material, defined by [Equation 1] as below, is 0.4 or less:

$$Ceq=[C]+[Mn]/6+([Cu]+[Ni])/15+([Cr]+[Mo]+[V])/5 \quad (1)$$

where [C], [Mn], [Cu], [Ni], [Cr], [Mo] and [V] may refer to contents (% by weight) of corresponding elements, respectively.

4. The steel material of claim 1, wherein the microstructure further includes 10% or less of pearlite.

5. The steel material of claim 1, wherein bainite has an average packet size of 5-20 μm.

6. The steel material of claim 1, wherein the V-based precipitate has an average diameter of 5-10 nm.

7. The steel material of claim 1, wherein the V-based precipitate has a maximum diameter of 20 nm or less.

8. The steel material of claim 1, wherein the steel material has yield strength: 500-700 MPa, tensile strength: 600-800 MPa, yield ratio: 80-85%, elongation: 20-30%, impact toughness at −30° C.: 80 J or more.

9. A method of manufacturing a steel material, the method comprising:

reheating a slab including, by weight %, C: 0.05-0.15%, Si: 0.5% or less (excluding 0%), Mn: 0.5-2.5%, Nb: 0.05% or less (excluding 0%), V: 0.004% or less (excluding 0%), Mo: 0.03-0.2%, Cr: 0.1-0.3%, P: 0.03% or less (excluding 0%), S: 0.015% (excluding 0%), Al: 0.05% or less (excluding 0%), N: 0.01% or less (excluding 0%), and a balance of Fe and other inevitable impurities at 1200-1400° C., obtaining a hot-rolled steel material by rough-rolling the reheated slab and finishing-rolling the slab at an austenite single-phase temperature;

water-cooling the hot-rolled steel material to a temperature of 650-750° C. at a rate of 40-60° C./sec and air-cooling the steel material for 3-7 seconds; and water-cooling the air-cooled hot-rolled steel material to a temperature of 450-600° C. at a rate of 30-50° C./sec and winding the steel material.

10. The method of claim 9, wherein the other inevitable impurities include at least one of Ni and Cu, and a content thereof is suppressed to Ni: 0.05% or less (excluding 0%) and Cu: 0.05% or less (excluding 0%).

11. The method of claim 9, wherein the reheating the slab is performed for 100-400 minutes.

12. The method of claim 9, wherein a thickness of the rough-rolled slab relative to a thickness of the reheated slab is 10-25%.

13. The method of claim 9, wherein a temperature of the finishing-rolling is 800-1000° C.

* * * * *